United States Patent [19]

Nagel et al.

[11] 4,277,061

[45] Jul. 7, 1981

[54] APPARATUS FOR CLASSIFYING PHOTOGRAPHIC PRINTS OR THE LIKE

[75] Inventors: Erich Nagel, Anzing; Rainer Türcke; Heinz Lüdemann, both of Munich, all of Fed. Rep. of Germany

[73] Assignee: AGFA-Gevaert, A.G., Leverkusen, Fed. Rep. of Germany

[21] Appl. No.: 971,118

[22] Filed: Dec. 19, 1978

[30] Foreign Application Priority Data

Dec. 23, 1977 [DE] Fed. Rep. of Germany ..... 2757848

[51] Int. Cl.[3] ..... B65H 29/60

[52] U.S. Cl. ..... 271/302; 83/106; 198/369; 198/439; 198/442; 209/656; 271/303; 271/DIG. 3

[58] Field of Search ..... 271/64, 172, 173, DIG. 3, 271/305, 303, 302, 297, 279; 209/656, 657; 198/442, 439, 367, 437, 369; 83/106

[56] References Cited

U.S. PATENT DOCUMENTS

| | | | |
|---|---|---|---|
| 1,296,727 | 3/1919 | Wright | 271/64 UX |
| 3,052,351 | 9/1962 | Hanstein | 209/657 X |
| 3,189,342 | 6/1965 | Bocock | 271/64 |

FOREIGN PATENT DOCUMENTS

| | | | |
|---|---|---|---|
| 1103250 | 3/1961 | Fed. Rep. of Germany | 198/442 |
| 1060011 | 2/1967 | United Kingdom | 209/657 |
| 1080188 | 8/1967 | United Kingdom | 209/657 |

*Primary Examiner*—Bruce H. Stoner, Jr.
*Attorney, Agent, or Firm*—Peter K. Kontler

[57] ABSTRACT

Apparatus for classifying photographic prints which are severed from the leader of a downwardly moving web of exposed and developed photographic paper has side walls which define a downwardly extending channel whose upper end constitutes an inlet for descending prints and whose lower end has two or more discrete outlets. The channel contains one or more blade-like switching members which are movable between several positions to thereby establish paths for descent of sheets from the inlet into a selected outlet. The switching member or members are movable between such positions by electromagnets which are installed externally of the channel and each of which can attract or release one or more swtiching members. The channel can be mounted on a pivotable carrier which can move at least one outlet between two different positions for admission of prints which descend through such outlet into either of two discrete receptacles.

25 Claims, 6 Drawing Figures

1a
1
7
8
INL
9
10
12
14
18
15
22
17
23
13
CH
26
28
29
27
11
26A
16
27A
19
24
20
21
25
4
5
6
P
3
2

APPARATUS FOR CLASSIFYING PHOTOGRAPHIC PRINTS OR THE LIKE

BACKGROUND OF THE INVENTION

The present invention relates to apparatus for manipulating webs and discrete sheets of paper or the like, particularly for manipulating webs of exposed and developed photographic paper and discrete sections or prints which are obtained in response to severing of such webs. Still more particularly, the invention relates to improvements in apparatus for automatically classifying prints or like discrete sheet-like commodities according to quality and/or other characteristics.

It is already known to classify discrete prints which are obtained by severing a web of exposed and developed photographic paper in response to detection of indicia which are applied to the web and are monitored by suitable detector means serving to transmit appropriate signals to certain parts of a classifying apparatus, e.g., an apparatus of the type disclosed in German Offenlegungsschrift No. 1,912,759. This publication discloses an apparatus which segregates unsatisfactory prints from satisfactory prints and is disposed behind a severing device which divides an elongated web of exposed and developed photographic paper into discrete sections or prints. A turntable is provided to segregate satisfactory prints from unsatisfactory prints, i.e., the turntable assumes a first position to direct each satisfactory print into a first path and a second position to divert unsatisfactory prints into a different second path. The turntable is pivotable about an axis which is parallel to the direction of forward movement of successive prints beyond the severing device. The versatility of the just described classifying apparatus is limited because it can properly classify only such prints which advance toward the turntable along a horizontal path.

German Offenlegungsschrift No. 2,345,804 discloses another classifying apparatus wherein a blade-like switching member can be moved between three different positions so as to direct oncoming sheets into a selected one of three different paths. A drawback of this apparatus is that it comprises a large number of conveyor belts, rollers and other components which contribute to its complexity, cost and sensitivity. The sheets are transported by pairs of rollers; this presents problems when the sheets are photographic prints which are normally curved so that the leader of an arcuate sheet is likely to strike against one of the rollers instead of entering the nip of such parts. Moreover, the mechanism for transporting the web toward the severing station is designed to advance the web along an arcuate path which further enhances the likelihood of flexing and unsatisfactory transport of and/or damage to or defacing of discrete sheets.

OBJECTS AND SUMMARY OF THE INVENTION

An object of the invention is to provide a classifying apparatus for photographic prints or the like which is simpler and more reliable than heretofore known apparatus.

Another object of the invention is to provide a classifying apparatus which comprises a small number of moving parts and can be designed to classify successively delivered prints or similar sheet-like commodities into two, three or more groups.

A further object of the invention is to provide a classifying apparatus whose operation is not affected by the curvature of sheets and which can direct successively delivered sheets into different paths at the rate at which such sheets are supplied thereto, e.g., at the rate at which a continuous or elongated web of exposed and developed photographic paper is severed by an automatic cutting device to yield a succession of discrete sections or prints including satisfactory and unsatisfactory as well as other types of prints.

An additional object of the invention is to provide the apparatus with novel and improved means for moving its mobile part or parts between several positions preparatory to directing an oncoming sheet into a path which is different from the path of the preceding sheet.

The invention is embodied in an apparatus for classifying successively delivered sheets of predetermined length, particularly for classifying sections (e.g., discrete photographic prints) which are severed from the leader of a web of exposed and developed photographic material (such as photographic paper) having indicia denoting different classes of sections. The apparatus comprises guide means preferably including two elongated side walls which define an elongated channel having an inlet and a plurality of outlets remote from the inlet, sheet diverting means including at least one switching member (e.g., a flexible or practically rigid plate or blade made of sheet metal or the like) consisting at least in part of magnetizable material and installed in the channel intermediate the inlet and the outlets for movement between a plurality of different positions in each of which the switching member establishes a path for movement of oncoming sheets from the inlet to a different outlet, and magnet means (preferably consisting of two or more electromagnets) which is located externally of the channel and is operable (energizable or deenergizable) to move the switching member to any one of the aforementioned plurality of positions.

The distance between the inlet and the outlets of the channel preferably equals or approximates the length of a section.

The switching member may comprise an extension which constitutes a partition between two neighboring outlets of the channel.

The novel features which are considered as characteristic of the invention are set forth in particular in the appended claims. The improved classifying apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
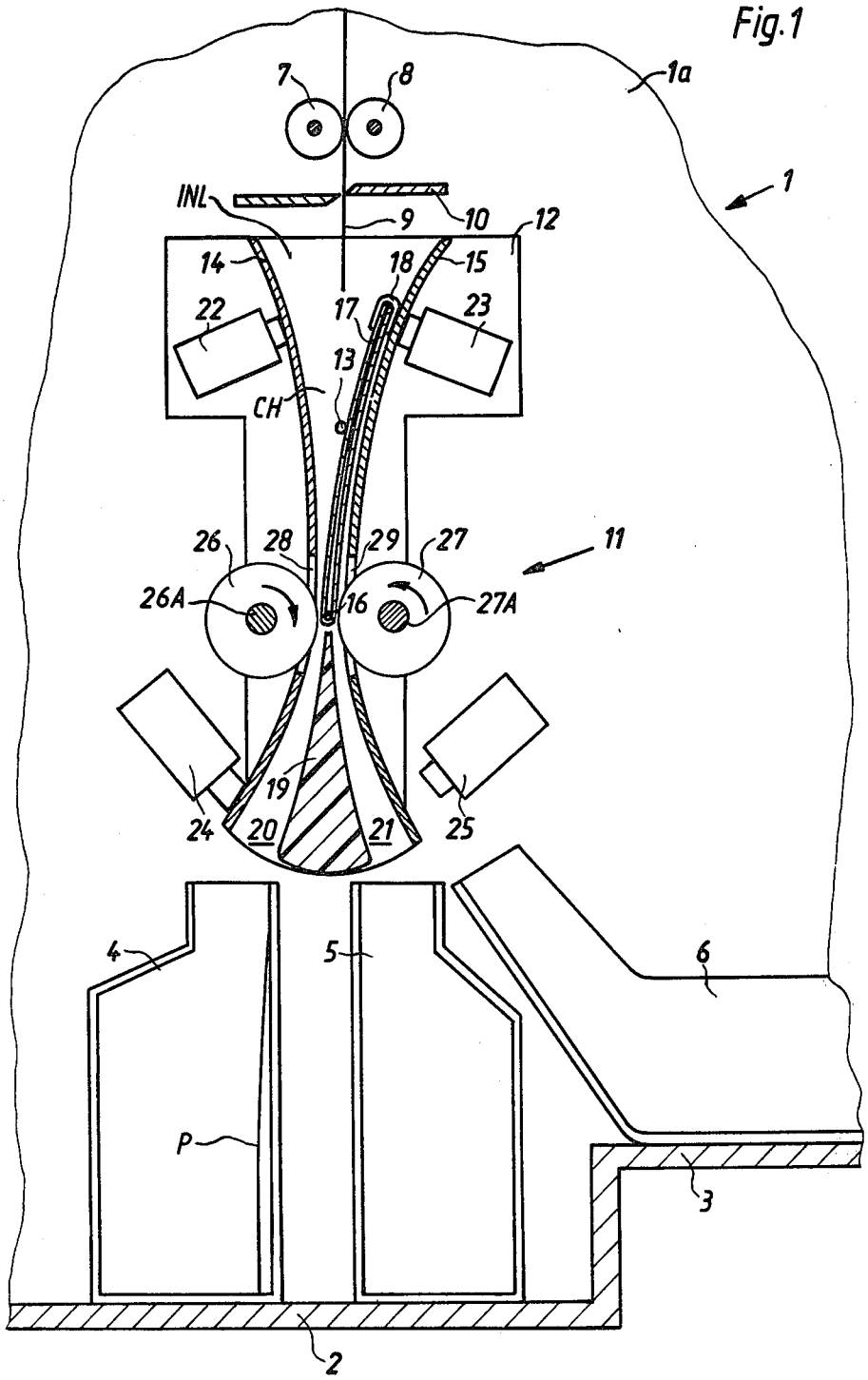
FIG. 1 is a schematic vertical sectional view of a classifying apparatus which embodies one form of the invention and can deliver different types of photographic prints into three discrete receptacles.

FIG. 1 shows a frame or housing 1 serving as a support for a classifying apparatus 11 which embodies one form of the invention. The frame 1 has an upright panel or wall 1*a* and two bottom walls 2 and 3 which are disposed at different levels. The bottom wall 2 supports two removable receptacles 4 and 5 in the form of upright bins, and the bottom wall 3 supports a third receptacle in the form of a tray 6. For example, the receptacle 4 may serve to collect and temporarily store acceptable photographic prints P which are ready to be shipped, mailed or delivered to customers or to shops which accept orders from customers; the receptacle 5 may serve for accumulation and temporary storage of prints constituting reproductions of images on film frames which must be copied again prior to mailing, shipment or delivery to customers; and the receptacle 6 accepts so-called exprints.

The upright panel or wall 1*a* supports two driven advancing rolls 7 and 8 for an elongated web 9 of exposed and developed photographic paper whose leader is severed at intervals to yield a succession of discrete prints which enter and are classified by the apparatus 11. The advancing rolls 7 and 8 are mounted at a level above a severing device 10 (shown only schematically because its construction forms no part of the present invention) which is actuated whenever a frame line is located between its knives or blades so that the apparatus 11 receives prints each of which carries the entire image of the respective film frame. The web 9 is drawn off a bobbin or roll (not shown).

The classifying apparatus 11 is mounted on the upright panel 1*a* at a level immediately below the severing device 10 and comprises a pendulum-like carrier 12 which is or may constitute a plate and is pivotable on or with a shaft 13 mounted in the panel 1*a*. The extent of pivotal movement of the carrier 12 is relatively small; it should suffice to enable the right-hand outlet 21 at the lower end of the apparatus 11 to move into register with the open upper end of the receptacle 5 or with the adjacent open upper side of the receptacle 6. In the absence of exprints, the carrier 12 will be held in the normal angular position which is shown in the drawing, i.e., the right-hand outlet 21 registers with the open top of the receptacle 5 and the left-hand outlet 20 registers with the open top of the receptacle 4.

The carrier 12 supports two arcuate guide members or side walls 14 and 15 which can consist of sheet metal or the like and together define a substantially hyperboloidal channel CH which tapers downwardly from its inlet INL below the severing device 10 and thereupon diverges in a direction toward the receptacles 4 and 5. The narrowest (median) portion of the channel CH between the guide members 14 and 15 is traversed by a horizontal supporting shaft 16 which is mounted in the carrier 12 and supports a flexible upper switching or diverting member 17. The illustrated switching member 17 is a plate made of elastic sheet material which is folded over itself and whose bight surrounds and is fixed to the supporting shaft 16 so that the upper part of the member 17 can be flexed toward the convex (e.g., part cylindrical) inner side of the guide member 14 or 15. Such construction insures that the switching member 17 is devoid of sharp corners. The upper end of this member is overlapped by a U-shaped clamp 18 which consists of magnetizable material so that it can be attracted by either one of two electromagnets 22, 23 which are mounted on the carrier 12 and are respectively adjacent to the outer sides of the upper portions of guide members 14 and 15.

The supporting shaft 16 is disposed at a level above the tip of a wedge-like rigid stationary partition 19 which diverges downwardly and defines with the lower portions of the guide members 14, 15 the aforementioned outlets 20 and 21 of the channel CH. The uppermost portion of the partition 19 is narrower than the lowermost portion of the switching member 17 so that it cannot intercept a descending print which is about to enter the outlet 20 or 21. The partition 19 can be said to constitute a downward extension of the switching member 17.

In FIG. 1, the electromagnet 23 is energized and attracts the upper portion of the flexible switching member 17 by attracting the clamp 18. Therefore, a freshly severed print P can descend into the space between the members 14, 17 and slides through the outlet 20 to enter the receptacle 4. If the electromagnet 22 is energized while the electromagnet 23 is deenergized, the electromagnet 22 attracts the clamp 18 so that the switching member 17 is adjacent to the guide member 14 and a print descends into the receptacle 5 (or 6) via outlet 21.

Two additional electromagnets 24 and 25 are mounted on the panel 1*a* at the outer sides of the outlets 20 and 21, i.e., they are respectively adjacent to lower portions of the guide members 14 and 15. At least such lower portions of the guide members 14, 15 consist of or carry inserts of magnetizable material. FIG. 1 shows the electromagnet 24 in energized condition; therefore, a pole of this electromagnet attracts the lower portion of the guide member 14 and maintains the carrier 12 in the normal position, i.e., in that position in which the outlets 20 and 21 of the channel CH respectively deliver prints to the receptacles 4 and 5. When the electromagnet 24 is deenergized and the electromagnet 25 is energized, the lower portion of the guide member 15 is attracted to the adjacent pole of the electromagnet 25 and the outlet 21 can deliver exprints into the receptacle 6.

The carrier 12 further supports two accelerating elements here shown as roller-shaped impellers 26, 27 whose shafts 26A, 27A flank the shaft 16 and are driven so as to rotate in the directions indicated by arrows. Portions of these impellers 26, 27 extend through openings 28 and 29 which are respectively provided in the guide members 14 and 15 so that the rapidly rotating impeller 26 cooperates with the left-hand side of the flexible switching member 17 to accelerate and propel prints into the receptacle 4 or the impeller 27 cooperates with the right-hand side of the switching member 17 to rapidly propel prints into the receptacle 5 or 6. The manner in which the shafts 26A and 27A are connected to a suitable prime mover (not shown) to rotate at a relatively high peripheral speed forms no part of the invention. The gaps between the impellers 26, 27 and the respective sides of the lower end portion of the switching member 17 are preferably narrow. The length of the channel CH between the inlet INL and outlets 20, 21 preferably equals or approximates the length of a print P.

The operation of the classifying apparatus 11 of FIG. 1 is as follows:

The web 9 is provided with indicia in the form of holes, notches, exposed markers, carbon spots or the like which are monitored and decoded by a conventional detector system serving to transmit signals for selective energization or deenergization of electromagnets 22 to 25. The rolls 7 and 8 advance the web 9 downwardly between the blades or knives of the severing device 10 which is actuated on detection of frame lines or other indicia denoting the boundaries between neighboring prints. The leader of the web 9 which is shown in FIG. 1 is assumed to constitute a satisfactory print; therefore, the electromagnets 23 and 24 are energized and the electromagnets 22 and 25 are deenergized. This enables the electromagnet 24 to maintain the carrier 12 in the normal position and the electromagnet 23 maintains the flexible switching member 17 in a position adjacent to the upper portion of the guide member 15. Thus, the satisfactory print P which is separated from the next-following portion of the web 9 descends in the channel CH between the members 14, 17, is accelerated by the impeller 26 and is caused to travel through the outlet 20 of the channel CH and into the receptacle 4.

The position of the switching member 17 can be changed immediately after the severing of the web 9, i.e., even during the interval of movement of one or both knives of the severing device 10 away from each other. Thus, the member 17 can be flexed toward the upper portion of the guide member 14 while the previously separated print is still in the space between the members 14 and 17 because such print is already engaged and accelerated by the impeller 26. The just mentioned flexing of the switching member 17 takes place in response to deenergization of the electromagnet 23 and simultaneously with or immediately following the energization of the electromagnet 22. If the next print is destined to enter the receptacle 5, the electromagnet 24 remains energized to prevent pivoting of the carrier 12 from the illustrated position. Such mode of changing the position of the switching member 17 (i.e., immediately after separation of the preceding print from the major portion of the web 9) insures that the classifying operation can proceed at a high speed because the interval between the delivery of a preceding print into the receptacle 4 and the delivery of the next-following print into the receptacle 5 (or vice versa) need not be longer than the interval between deliveries of two successive prints into the receptacle 4 or 5. High output of the classifying apparatus is desirable in modern photographic processing laboratories which must process thousands of prints per hour.

If the aforediscussed detector system generates a signal which denotes the arrival of an exprint at the severing station, the electromagnet 24 is deenergized with requisite delay and the electromagnet 25 is energized at the same time or immediately thereafter so that the carrier pivots 12 counterclockwise, as viewed in FIG. 1, and moves the outlet 21 above the receptacle 6. If the flexible switching member 17 is held in the position of FIG. 1, the electromagnet 23 is deenergized simultaneously with the electromagnet 24 and the electromagnet 22 is energized to attract the member 17 to the inner side of the upper portion of the guide member 14 so that the freshly severed exprint descends in the space between the members 15, 17, is accelerated by the impeller 27 and enters the receptacle 6 via outlet 21.

Figure 2:
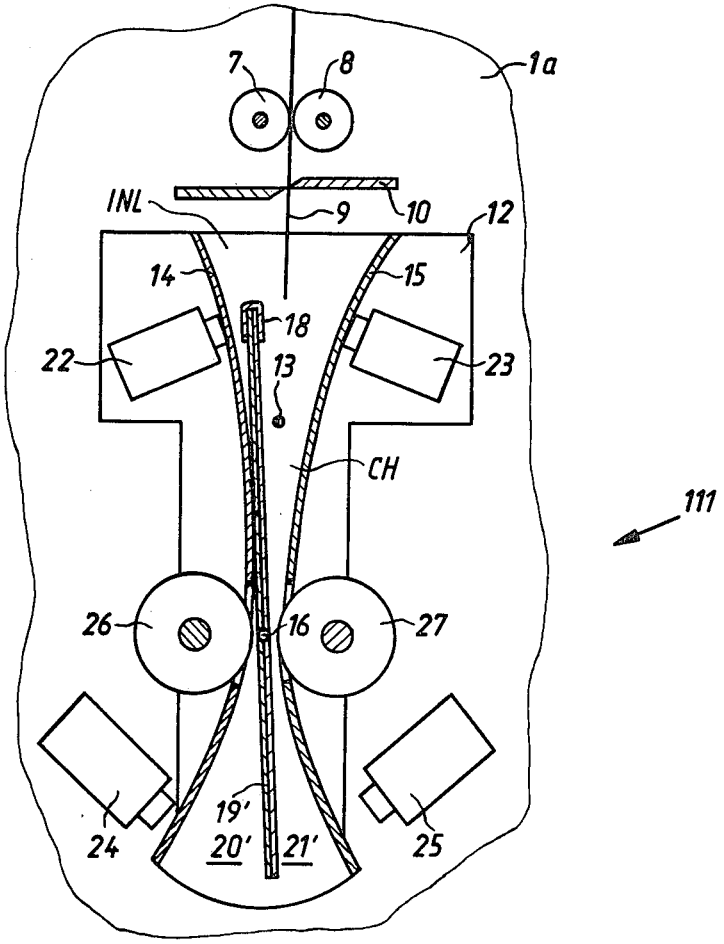
FIG. 2 is a similar sectional view of a second classifying apparatus with a one-piece switching or sheet-diverting member.

FIG. 2 shows a modified classifying apparatus 111 wherein all such parts which are identical with or clearly analogous to corresponding parts of the apparatus 11 of FIG. 1 are denoted by similar reference characters. The apparatus 111 also employs a single switching or diverting member 19' which replaces the member 17 and the extension or partition 19 of FIG. 1 and whose flexibility is limited, i.e., its upper end portion need not be flexed all the way to the convex inner side of the upper portion of the guide member or side wall 14 or 15. The switching member 19' is pivotable on or with the supporting shaft 16 between the illustrated position in which it is substantially tangential to the convex inner side of the guide member 14 and the clip 18 is located to the left of the descending print so that such print is entrained by the impeller 27 and enters the outlet 21', and a second position in which the member 19' is substantially tangential to the convex inner side of the guide member 15 whereby a descending print moves into the range of the impeller 26 and is expelled via outlet 20'. The means for pivoting the member 19' comprises the electromagnets 22 and 23. The carrier 12 is pivotable by the electromagnets 24 and 25.

Figure 3C:
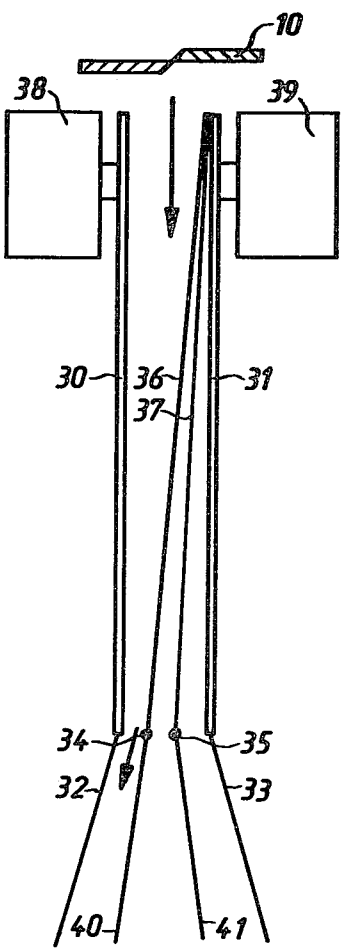
FIG. 3*c* is a similar view of the structure of FIG. 3*a* but with the switching members in positions they assume for admission of prints into the left-hand outlet.
Figure 3B:
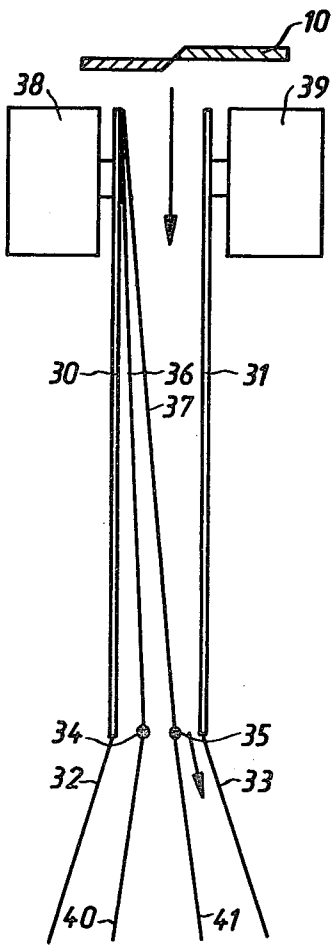
FIG. 3*b* illustrates the structure of FIG. 3*a* but with the switching members in positions they assume for admission of prints into the right-hand outlet.
Figure 3A:
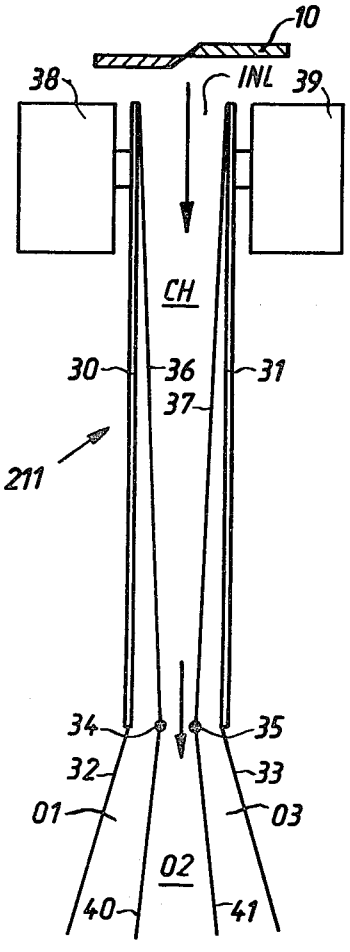
FIG. 3*a* is a schematic elevational view of a third apparatus with three discrete outlets and two mobile switching members which are shown in positions they assume when the prints are to enter the median outlet.

FIGS. 3*a*, 3*b* and 3*c* illustrate a third classifying apparatus 211 wherein two electromagnets 38 and 38 suffice to steer a sheet into a selected one of three outlets, i.e., into an outlet 02 for satisfactory prints, an outlet 03 for prints bearing images of film frames which must be copied again, or an outlet 01 for exprints.

The apparatus 211 comprises two mobile switching or diverting members 36 and 37 which are disposed between parallel or nearly parallel upright and straight guide members or side walls 30 and 31. The upper ends of the members 30 and 31 are located close to or immediately below the severing device 10. The lower end portions of the guide members 30, 31 are respectively adjacent to or connected with downwardly and outwardly diverging elements 32 and 33 which may consist of sheet metal and constitute the outermost walls of the three outlets 01, 02 and 03. The lower end portions of the guide members 30, 31 are disposed at the level of two parallel horizontal supporting shafts 34, 35 for the switching members 36 and 37. Two additional plate-like elements 40 and 41 extend downwardly from the shafts 34 and 35 and are respectively aligned with the switching members 36 and 37. The elements 32 and 40 define the outlet 01; the elements 40, 41 define the outlet 02; and the elements 41, 33 define the outlet 03.

The length of the switching members 36, 37 equals or approximates the length of the guide members 30, 31, as considered in the direction of downward movement of prints into the inlet INL and through the channel CH of the classifying apparatus 211. The electromagnets 38 and 39 can be mounted directly on the outer sides of upper portions of the guide members 30 and 31. The switching members 36, 37 may but need not be flexible, and each thereof can be mounted on the respective supporting shaft 34, 35 in the same way as described in connection with the flexible switching member 17 and supporting shaft 16 of FIG. 1. As will be readily appreciated upon perusal of the following description of operation of the classifying apparatus 211, flexibility of the switching members 36 and 37 is not necessary.

The mounting of switching members 36, 37 on the respective supporting shafts 34 and 35 is such that the members 36, 37 are substantially parallel to the guide members 30, 31 and to each other when the electromagnets 38 and 39 are deenergized. Thus, the channel CH between the guide members 30, 31 is divided into three upright narrower channels or paths each of which communicates with one of the outlets 01 to 03. If the electromagnets 38 and 39 are energized simultaneously (see FIG. 3*a*), the upper portions of switching members 36, 37 are respectively flexed or pivoted toward the guide members 30 and 31 so that the median path is wide at the upper end and tapers downwardly toward the median outlet 02. The outlet 02 preferably serves for delivery of satisfactory prints to a receptacle corresponding to the receptacle 4 of FIG. 1.

If the electromagnet 39 is deenergized, the electromagnet 38 continues to attract the switching member 36 and also attracts the switching member 37 (see FIG. 3*b*) so that the prints descend into the outlet 03. Attraction of switching member 37 by the electromagnet 38 is facilitated due to the fact that, when the electromagnet 39 is deenergized, the switching member 37 automatically returns to its unstressed position of substantial parallelism with the guide members 30, 31, i.e., it moves closer to and can be readily attracted by the energized electromagnet 38. The outlet 03 can deliver prints into a receptacle corresponding to the receptacle 5 of FIG. 1.

If the electromagnet 38 is deenergized and the electromagnet 39 is energized (see FIG. 3*c*), the switching members 36, 37 automatically return to the unstressed positions of parallelism with the guide members 30, 31 and are thereupon attracted toward the guide member 31 so that an oncoming print descends into the outlet 01, e.g., to enter a receptacle corresponding to the receptacle 6 of FIG. 1.

When the switching members 36, 37 dwell in the positions of FIG. 3*b* or 3*c* and are to return to the positions which are shown in FIG. 3*a*, they must perform the corresponding movements in two successive stages. Thus, the electromagnet 38 (FIG. 3*b*) or 39 (FIG. 3*c*) is deenergized so that the switching members 36 and 37 are free to reassume their normal or unstressed positions of substantial paralleism with the guide members 30, 31. The electromagnets 38 and 39 are thereupon energized at the same time whereby the electromagnet 38 attracts the upper portion of the switching member 36 and the electromagnet 39 attracts the upper portion of the switching member 37. The classifying apparatus 211 is then ready for delivery of satisfactory prints into the corresponding receptacle. The reason for the just discussed two-stage transition from the condition shown in FIG. 3*b* or 3*c* to the condition shown in FIG. 3*a* is that neither of the two electromagnets 38, 39 should be strong enough to successfully attract a switching member 36, 37 which is already attracted by the other of the electromagnets 38, 39. Otherwise, minor differences between the attracting forces of the electromagnets 38 and 39 could result in movement of the switching member 36 or 37 from the position of FIG. 3*a* to the position of FIG. 3*c* or 3*b*.

Figure 4:
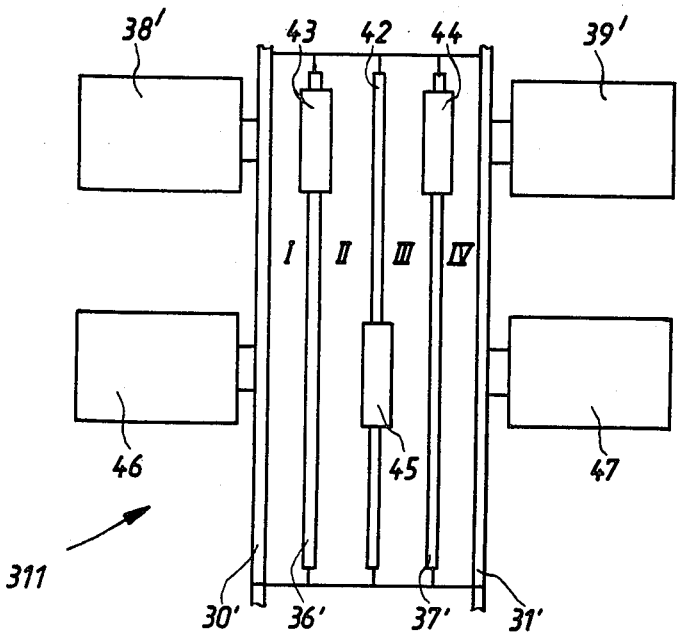
FIG. 4 is a schematic plan view of a classifying apparatus having a channel with four outlets.

FIG. 4 shows a fourth classifying apparatus 311 which constitutes a modification of the apparatus 211 and whose channel has four discrete outlets. The apparatus 311 comprises outer switching or diverting members 36' and 37' which correspond to the similarly referenced switching members of FIGS. 3*a* to 3*c*, and a third or intermediate switching or diverting member 42 between the members 36', 37'. The width of the four paths I, II, III, IV (each of which communicates with a discrete outlet) is preferably the same or at least approximates a standard width, provided, of course, that the three switching members 36', 37', 42 are permitted to assume their unstressed positions which are shown in FIG. 4. It is to be noted that FIG. 4 is a schematic plan view of the classifying apparatus 311.

The two outer paths I and IV are flanked by two upright guide members or side walls 30' and 31'. The distance between these guide members preferably exceeds the distance between the guide members 30, 31 of FIGS. 3*a*–3*c*. The switching members 36', 42 and 37' are flexible. The upper portions of the outer switching members 36' and 37' carry strongly magnetizable clamps 43 and 44 which are respectively adjacent to electromagnets 38', 39' and are disposed off center. A strongly magnetizable clamp 45 is mounted on the upper portion of the intermediate switching member 42 and is out of register with the clamps 43, 44. The clamp 45 is disposed between two electromagnets 46 and 47. The electromagnets 38', 46 and 39', 47 are respectively mounted on or adjacent to the outer sides of upper portions of the guide membes 30' and 31'.

The operation of the apparatus 311 of FIG. 4 is as follows:

Prior to each adjustment of the switching members 36', 37' 42, all four electromagnets 38', 39', 46 and 47 are deenergized so that the switching members 36', 37, 42 are free to assume the illustrated unstressed positions. A freshly severed print (not shown) which is to descend in the path I in a direction toward the plane of FIG. 4 will enter the upper end of the channel upon energization of the electromagnets 39' and 47. The electromagnet 39' attracts the upper portions of the switching members 36' and 37' (i.e., the clamps 43 and 44), and the electromagnet 47 attracts the intermediate switching member 42 (i.e., the clamp 45). Thus, the upper portions of all three switching members 36', 37', 42 are adjacent to the upper portion of the guide member 31' whereby a freshly severed print descends in the downwardly tapering path I between the left-hand side of the switching member 36' and the right-hand side of the guide member 30'.

The path II is ready to receive one or more prints in response to energization of the electromagnets 38', 39' and 47. It will be recalled that all electromagnets 38', 39', 46, 47 must be deenergized prior to energization of electromagnets 38', 39', and 47, i.e., the upper portions of all three switching members 36', 37', 42 must return to their unstressed positions prior to adjustment of the apparatus 311 for admission of prints into the path II. The energized electromagnet 38' attracts the upper portion of the switching member 36' via clamp 43, the energized electromagnet 39' attracts the upper portion of the switching member 37' via clamp 44, and the energized electromagnet 47 attracts the intermediate switching member 42 via clamp 45. A descending print then enters the path II, i.e., it enters the downwardly tapering space between the members 36' and 42.

The path III is ready to receive one or more prints in response to energization of electromagnets 38', 39' and 46. These electromagnets respectively attract the upper portions of the switching members 36', 37' and 42 so that a freshly severed print descends in the downwardly tapering path III to enter the corresponding receptacle or to descend onto a conveyor.

The path IV is ready to receive prints in response to energization of electromagnets 38' and 46. The electromagnet 38' attracts the clamps 43, 44 and the electromagnet 46 attracts the clamp 45. A freshly severed print then enters the path IV which is disposed between the right-hand side of the switching member 37' and the left-hand side of the guide member 31'.

At least some of the mobile switching members, especially the switching members 36, 37, 36', 37' and 42, may consist of nonmagnetic sheet metal having a thickness which is a fraction of one millimeter, e.g., 0.2 mm. The clamps 43, 44 and 45 can merely constitute reinforcing elements which enhance the attracting force of the respective electromagnets. Each of the electromagnets may constitute a simple DC-electromagnet.

An important advantage of the improved apparatus is that the web 9 need not be guided along a meandering path. Thus, the web 9 can be fed vertically downwardly so that each print P which is severed from its leader can move into the inlet of the channel and along the selected path into the corresponding outlet. The leader of the downwardly moving web 9 can enter the inlet of the channel between the side walls 14–15, 30–31 or 30'–31' even before it is severed by the knives of the severing device 10. As a rule, the corresponding path is selected at a time when the severing device 10 is actuated to separate a fresh print P from the web 9. This invariably insures predictable transport of the web 9 into the classifying apparatus to thus increase the output of such apparatus and to reduce the number of rejects which are attributable to faulty operation of the classifying means.

An apparatus which can be readily adapted for transmission of appropriate signals to the electromagnets 22 to 25 of the embodiments of FIGS. 1 and 2 (as well as to the corresponding electromagnets in other embodiments of our apparatus) is disclosed in commonly owned U.S. Pat. No. 3,948,125 granted Apr. 6, 1976 to Hujer et al. Such apparatus would comprise means for detecting different indicia which are applied to the prints P during inspection of the web 9 ahead of the severing station and denote prints which, with reference to the embodiment of FIG. 1, are to be respectively introduced into the receptacles 4, 5 and 6. The signals from the detecting means respectively energize the electromagnets 23 and 24, 22 and 24, and 22 and 25 in order to cause the corresponding prints to enter the receptacles 4, 5 and 6.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. Apparatus for classifying successively delivered sheets of predetermined length, particularly for classifying sections which are severed from the leader of a web of exposed and developed photosensitive material having indicia denoting different classes of sections, comprising a support; a carrier pivotally mounted on said support; guide means mounted on said carrier for pivoting therewith and defining an elongated channel having an inlet and a plurality of outlets remote from said inlet; sheet diverting means including at least one switching member consisting at least in part of magnetizable material, mounted on said carrier for pivoting therewith, and installed in said channel intermediate said inlet and said outlets, said member being movable between a plurality of different positions in each of which it establishes a path for movement of oncoming sheets from said inlet to a different outlet; first magnet means mounted on said carrier for pivoting therewith, located externally of said channel and being operable to move said member to any one of said positions; and second magnet means mounted on said support and operable to pivot said carrier with respect to said support.

2. Apparatus as defined in claim 1, wherein the distance between said inlet and said outlets approximates said predetermined length.

3. Apparatus as defined in claim 1, wherein said guide means comprises first and second side walls which converge in a direction from said inlet toward said outlets and further comprising supporting means for said switching member, said supporting means being disposed in said channel in the region of said outlets.

4. Apparatus as defined in claim 3, wherein said switching member is flexible and said magnet means comprises first and second electromagnets outwardly adjacent the respective side walls in the region of said inlet and being energizable to attract said switching member to the respective side wall.

5. Apparatus as defined in claim 4, wherein said side walls have convex surfaces flanking said channel.

6. Apparatus as defined in claim 3, wherein said supporting means is a stationary shaft and said switching member includes a lower end portion fixedly secured to said shaft.

7. Apparatus as defined in claim 3, wherein said channel includes a portion of minimum width and said supporting means is located in said portion of said channel.

8. Apparatus as defined in claim 3, wherein said switching member comprises an extension disposed between said outlets.

9. Apparatus as defined in claim 8, wherein said channel has two outlets.

10. Apparatus as defined in claim 3, wherein said side walls have openings in the region of said supporting means and further comprising sheet-accelerating impellers extending through said openings to engage and propel sheets in the respective paths into the corresponding outlets.

11. Apparatus as defined in claim 10, wherein each of said impellers comprises a driven roller which extends into close proximity of said switching member.

12. Apparatus as defined in claim 1, wherein at least a portion of said guide means consists of magnetizable material and said second magnet means comprises a plurality of electromagnets secured to said support and being energizable to thereby pivot said carrier clockwise or counterclockwise.

13. Apparatus as defined in claim 12, wherein said carrier is pivotable about an axis which extends substantially transversely of the direction of advancement of sheets in said channel.

14. Apparatus for classifying successively delivered sheets of predetermined length, particularly for classifying sections which are severed from the leader of a web of exposed and developed photosensitive material having indicia denoting different classes of sections, comprising guide means defining an elongated channel having an inlet and a plurality of outlets remote from said inlet and including two elongated side walls flanking said channel; sheet diverting means including at least two switching members each consisting at least in part of a permanently magnetically attractable material and installed in said channel intermediate said inlet and said outlets, said switching members normally assuming respective rest positions in which they are spaced from each other and from the neighboring side walls and being movable from said rest positions to different active positions in each of which they establish a path for movement of oncoming sheets from said inlet to a different outlet; and magnet means located externally of said channel and including two electromagnets each outwardly adjacent to one of said side walls and being selectively energizable to magnetically attract said switching members from said rest positions to said active positions in which each of said two switching members is situated at the respective neighboring side wall or both switching members are situated at one or the other side wall.

15. Apparatus as defined in claim 14, wherein said channel has three outlets and further comprising substantially plate-like elements disposed between said outlets and in register with said switching members.

16. Apparatus as defined in claim 14, wherein said side walls are substantially parallel to each other and further comprising supporting means for maintaining said switching members in positions of substantially parallelism with said side walls in deenergized condition of said electromagnets.

17. Apparatus as defined in claim 16, wherein said switching members are flexible.

18. Apparatus as defined in claim 1, wherein said switching member comprises an end portion adjacent said inlet and consisting of magnetizable material, said first magnet means including electromagnets outwardly adjacent said guide means at the opposite sides of said end portion.

19. Apparatus for classifying successively delivered sheets of predetermined length, particularly for classifying sections which are severed from the leader of a web of exposed and developed photosensitive material having indicia denoting different classes of sections, comprising guide means defining an elongated channel having an inlet and a plurality of outlets remote from said inlet and including first and second elongated side walls flanking said channel; sheet diverting means including three switching members each consisting at least in part of magnetizable material and installed in said channel intermediate said inlet and said outlets such that first and second ones of said switching members are respectively adjacent to one of said side walls and the third switching member is situated intermediate said first and second switching members, each of said switching members being movable between a plurality of different positions in each of which said switching members establish a path for movement of oncoming sheets from said inlet to a different outlet; and magnet means located externally of said channel and including first and second electromagnets outwardly adjacent to said first and second side walls and being energizable to respectively attract said first and second switching members, and third and fourth electromagnets respectively adjacent to said first and second side walls and being energizable to respectively attract said third switching member, to the corresponding side wall.

20. Apparatus as defined in claim 19, wherein said side walls are flat and said switching members are substantially equidistant from each other and from the neighboring side walls in deenergized condition of said electromagnets.

21. Apparatus as defined in claim 19, further comprising supporting means for said switching members, said supporting means being located in said channel in the region of said outlets.

22. Apparatus as defined in claim 19, wherein said switching members have magnetizable portions, the magnetizable portions of said first and second members being respectively adjacent said first and second electromagnets and the magnetizable portion of said third member being disposed between said third and fourth electromagnets.

23. Apparatus as defined in claim 14, wherein said diverting means comprises at least one additional switching member intermediate said two switching members; and wherein each of said electromagnets is energizable to attract at least one of said switching members subsequent to deenergization of all of said electromagnets.

24. Apparatus as defined in claim 1, wherein said outlets are disposed below said inlet so that a sheet which is admitted into said inlet can advance toward the selected outlet by gravity.

25. Apparatus as defined in claim 1, wherein said diverting means comprises a single flexible switching member and said channel has two outlets, said switching member having a wedge-like extension which constitutes a partition between said outlets.

* * * * *